US005585773A

United States Patent [19]

Murata et al.

[11] Patent Number: 5,585,773

[45] Date of Patent: Dec. 17, 1996

[54] IGNITION COIL FOR INTERNAL COMBUSTION ENGINE

[75] Inventors: Shigemi Murata; Mitsuru Koiwa; Yutaka Ohashi, all of Hyogo, Japan

[73] Assignee: Mitsubishi Denki Kabushiki Kaisha, Tokyo, Japan

[21] Appl. No.: 215,025

[22] Filed: Mar. 21, 1994

[30] Foreign Application Priority Data

Jul. 9, 1993 [JP] Japan ..... 5-170417

[51] Int. Cl.[6] ..... H01F 27/02

[52] U.S. Cl. ..... 336/90; 336/96; 336/107

[58] Field of Search ..... 336/92, 90, 96, 336/107; 123/621, 634, 635

[56] References Cited

U.S. PATENT DOCUMENTS 4,112,481 9/1978 Roge et al. ..... 336/96
4,248,201 2/1981 Tsutsui et al. ..... 123/647
5,109,209 4/1992 Ida et al. .
5,261,381 11/1993 Sugiura et al. ..... 336/96

FOREIGN PATENT DOCUMENTS 587034 4/1993 Japan ..... F02P 15/00

*Primary Examiner*—Thomas J. Kozma
*Attorney, Agent, or Firm*—Sughrue, Mion, Zinn, Macpeak & Seas

[57] ABSTRACT

A plurality of transformers each comprised of a core, a primary winding, and a secondary winding are accommodated in one case, the transformers are incorporated in alternately different directions, high-tension terminals, to which output ends of the secondary winding are connected, are provided on a side opposite to the side where a core disposed outside the secondary winding is located, and a layer of a resin minimum for insulation is provided between adjacent ones of the secondary windings.

3 Claims, 3 Drawing Sheets

IGNITION COIL FOR INTERNAL COMBUSTION ENGINE

BACKGROUND OF THE INVENTION

This invention relates to an ignition coil for supplying a high voltage to an ignition plug of an internal combustion engine.

FIG. 5 is a top plan view of a conventional ignition coil; FIG. 6 is a side elevation view illustrating a state in which a high-tension cable is connected to the conventional ignition coil; and FIG. 7 is a cross-sectional view illustrating an internal configuration of the conventional ignition coil. In FIGS. 5, 6, and 7, reference numeral 1 denotes a case for accommodating a plurality of transformers; 2, a high-tension tower for forming an output terminal of each transformer; 9, a high-tension cord for introducing an output of the ignition coil to an ignition plug; and 10, a boot for sealing a high-tension connecting portion. In FIG. 7, numeral 3 denotes a core; 4, a primary winding wound around the core; 5, a secondary winding magnetically coupled to the primary winding 4 via the core 3 wound around an outer periphery of the primary winding; 6, a high-tension terminal disposed in the high-tension tower 2 connected to both ends of the secondary winding; and 8, a resin insulating and fixing the core 3, the primary winding 4, and the secondary winding 5.

Next, a description will be given of the operation. The current flowing across the primary winding 4 is energized and de-energized by an external device (not shown), and at that time a high voltage of 30 kV or thereabouts is generated in the secondary winding 5, and is introduced to an ignition plug (not shown) via the high-tension terminal 6 and the high-tension cord 9. An ignition plug corresponding to each cylinder of an internal combustion engine is connected to each high-tension terminal 6. However, in the cylinders other than the cylinders to be ignited, the pressure within the cylinders is low, so that the voltage for starting an electric discharge in the ignition plugs is appreciably lower than that for the cylinders to be ignited. Adjacent ones of the high-tension terminals 6 are insulated from each other by the high-tension towers 2 and the boots 10, and adjacent ones of the secondary windings 5 are also insulated from each other by the resin 8.

Since the conventional ignition coil in which a plurality of transformers are accommodated in a single case is arranged as described above, there has been a problem in that since a large distance needs to be provided between adjacent ones of the high-tension towers 2 in order to ensure the insulating properties of adjacent ones of the high-tension terminals 6, the size of the outside shape becomes large. In addition, there has been another problem in that, as a result of the increase in the size of the outside shape, the interval between adjacent ones of the secondary windings 5 becomes more than a dimension required for insulation, so that the amount of the resin 8 increases and the weight increases.

SUMMARY OF THE INVENTION

The present invention has been devised to overcome the above-described problems, and its object is to obtain an ignition coil for an internal combustion engine which can be made compact and lightweight, and for which insulating properties equivalent to those of the prior art can be ensured.

In an ignition coil for an internal combustion engine in accordance with the present invention, a plurality of transformers accommodated in a case are incorporated in alternately different directions inside the case, whereby an insulation distance between high-tension terminals with secondary winding ends of the respective transformers connected thereto is secured by a degree equivalent to or greater than in a conventional case, and an interval between secondary windings of the ignition coil is kept to a minimum necessary for insulation.

In the ignition coil for an internal combustion engine in accordance with the present invention, since the plurality of transformers accommodated in a case are incorporated in alternately different directions inside the case, even if the insulation distance between adjacent ones of the high-tension terminals is secured, the interval between adjacent ones of the secondary windings in the case can be kept to a necessary minimum.

DETAILED DESCRIPTION OF PREFERRED EMBODIMENTS

Figure 1:
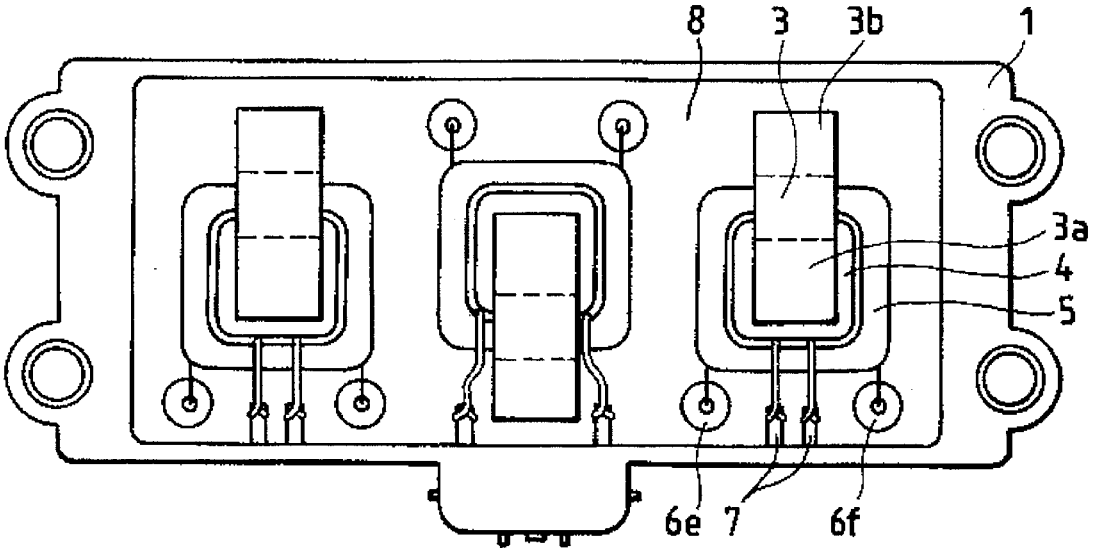
FIG. 1 is a rear view illustrating a state of the configuration of an ignition coil in accordance with an embodiment of the present invention.
Figure 3:
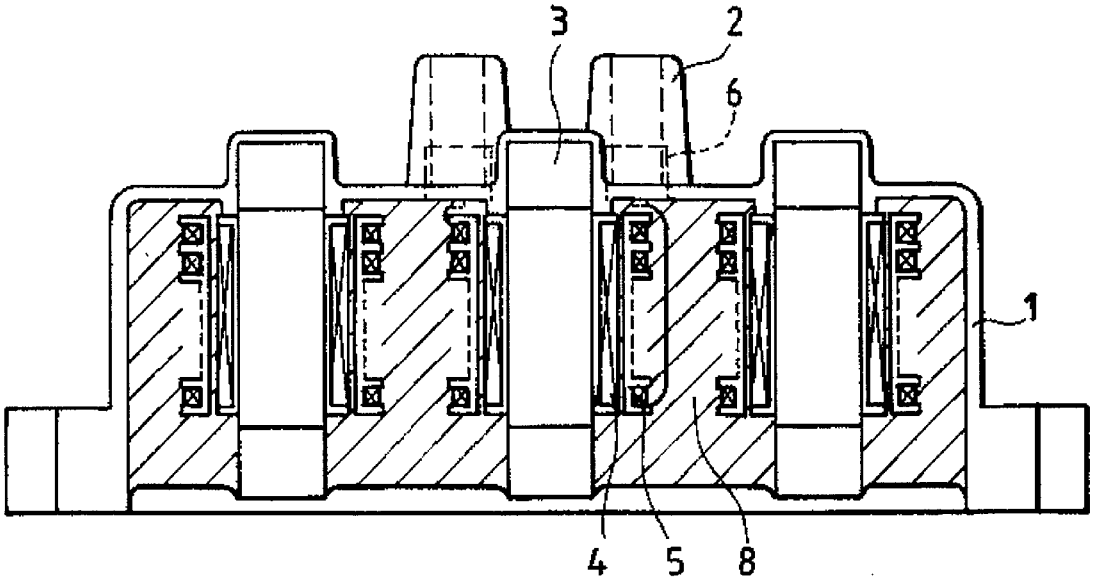
FIG. 3 is a cross-sectional front elevation view illustrating the ignition coil in accordance with the embodiment of the present invention.

FIG. 1 is a diagram illustrating a state in which three transformers are incorporated in a case 1, and FIGS. 3 an 4 are cross-sectional views illustrating an internal structure.

Figure 4:
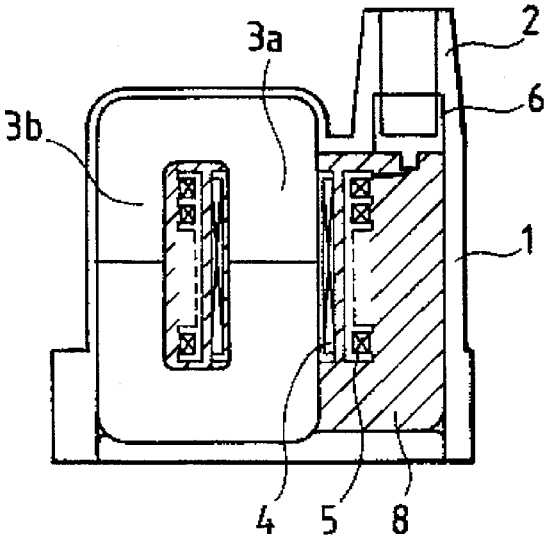
FIG. 4 is a cross-sectional side elevation view illustrating the ignition coil in accordance with the embodiment of the present invention.
Figure 5:
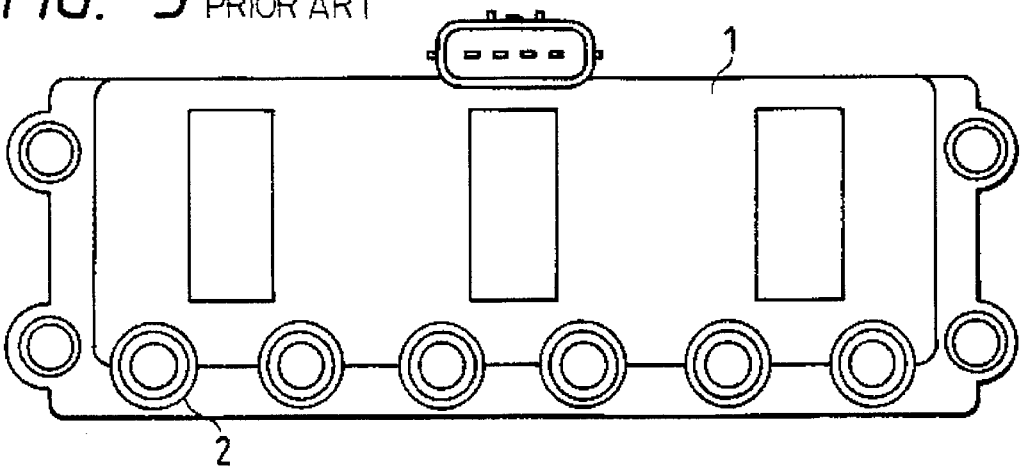
FIG. 5 PRIOR ART
FIG. 5 is a top plan view illustrating a conventional ignition coil.
Figure 6:
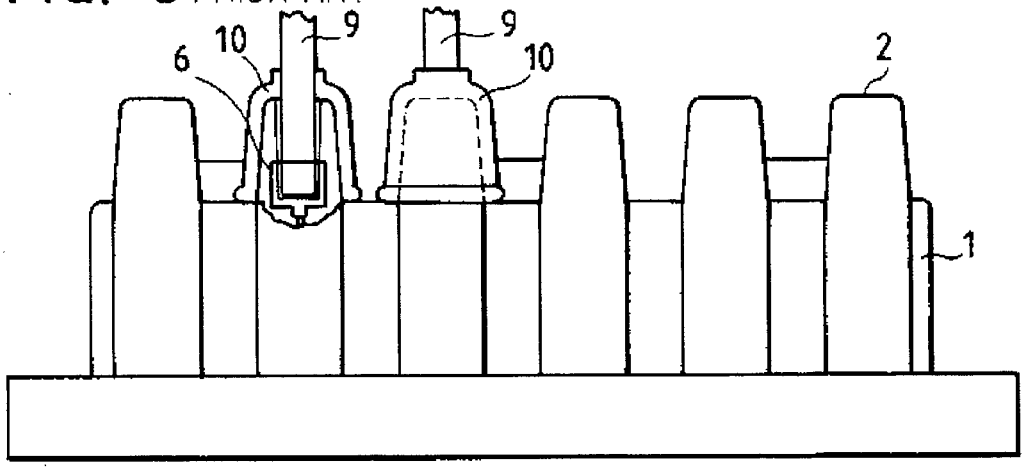
FIG. 6 PRIOR ART
FIG. 6 is a front elevation view illustrating the conventional ignition coil.
Figure 7:
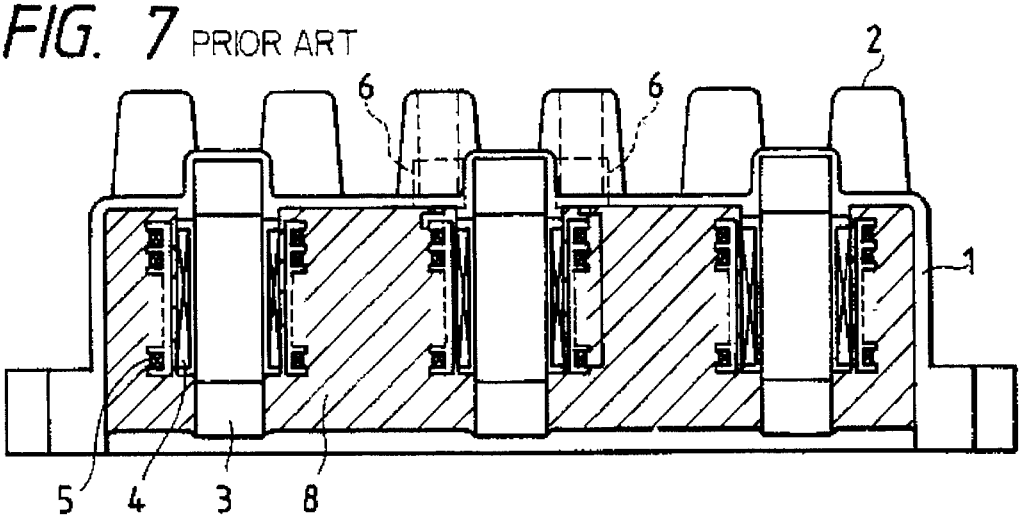
FIG. 7 PRIOR ART
FIG. 7 is a cross-sectional front elevation view illustrating the conventional ignition coil.

In FIGS. 1, 3, and 4, a primary winding 4 and a secondary winding 5 are wound around a core 3, thereby constituting a transformer. The core 3 forms a closed magnetic path by looping a loop by means of an inner core **3*a* located inside the primary winding 4 and the secondary winding 5 and an outer core 3*b* located outside the same, and the outer core 3*b* is disposed at a position in which it projects outside the secondary winding 5. Three transformers each arranged as described above are incorporated in one case 1, and the directions in which the outer cores 3*b* of the respective transformers are located are arranged in alternately different directions. In each transformer, an end of the primary winding 4 is connected to a terminal 7 insert-molded in the case 1, while an output end of the secondary winding 5 is connected to a high-tension terminal 6 insert-molded in the case 1. The high-tension terminal 6 is disposed inside a high-tension tower 2, and a high voltage generated in the secondary winding 5 is supplied to an ignition plug of an internal combustion engine via a high-tension cord (not shown) inserted in the high-tension tower 2**.

Figure 2:
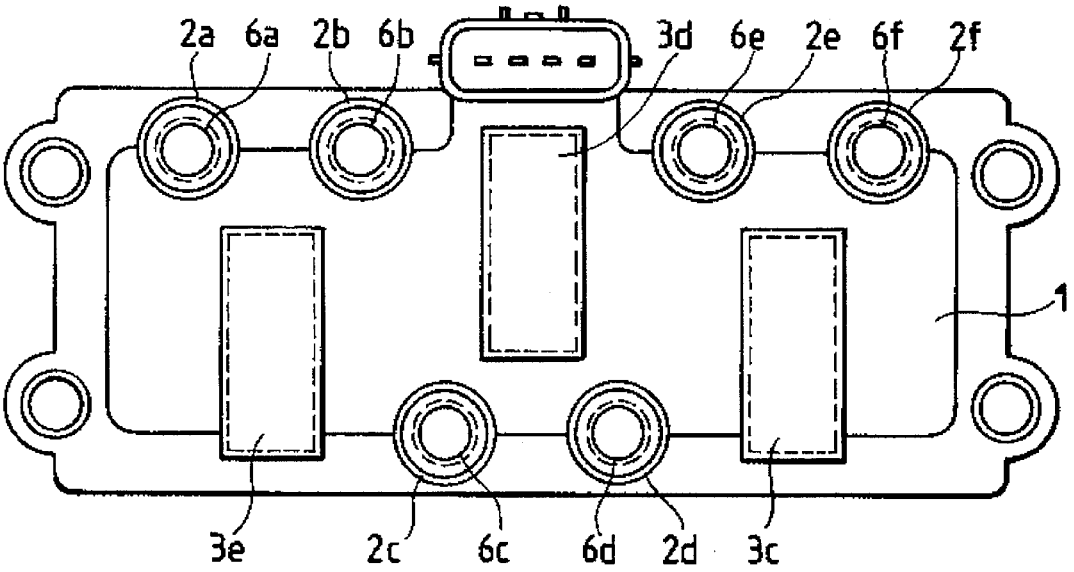
FIG. 2 is a top plan view illustrating the ignition coil in accordance with the embodiment of the present invention.

FIG. 2 shows the positional relationships of six high-tension towers **2*a*, 2*b*, 2*c*, 2*d*, 2*e*, and 2*f* and three cores 3*c*, 3*d*, and 3*e* which are viewed from the high-tension tower 2 side. The high-tension terminal 6 is disposed inside each of the high-tension towers 2. In the case of a high-tension terminal 6***d*, for example, the creepage distance for insulation is maintained by a high-tension terminal 6*c* for forming another output end of the same secondary winding 5, the cores 3*d* and 3*c*, the high-tension towers 2*d* and 2*c*, and the case 1, so that the insulating properties are ensured in a case where the high-tension cord for introducing a high voltage to the ignition plug is connected. Here, a sufficient insulation distance is secured with respect to a high-tension terminal 6*e* for forming an output end of another secondary winding since the transformers are incorporated in the case 1 in alternately different directions.

Inside the case 1, each transformer is insulated and secured by means of a resin 8, and the thickness of the resin for insulating adjacent ones of the secondary windings 5 from each other can be kept to a necessary minimum without being restricted by the insulation distance between the high-tension terminals 6 connected to the respective secondary windings 5, e.g., the insulation distance between a high-tension terminal 6*b* and the high-tension terminal 6*c*. Accordingly, the device can be made compact and lightweight.

Although in the foregoing embodiment a case has been illustrated in which three transformers are accommodated in one case, the number of transformers is not limited to three, and a similar effect is obtained insofar as a plurality of transformers are provided.

In addition, although in the foregoing embodiment a case has been illustrated in which the high-tension towers are formed integrally with the case and the high-tension terminals are insert-molded in the case, a similar effect can be obtained in an arrangement in which the high-tension towers are formed separately from the case, and the high-tension towers, after being respectively mounted over the secondary windings, are fixed by the resin simultaneously with the transformers, and are disposed on an open surface of the case.

As described above, in accordance with the present invention, since the plurality of transformers accommodated in one case are incorporated in alternately different directions, it is possible to obtain advantages in that the insulation distance between adjacent ones of the high-tension terminals can be secured, that the resin insulation distance between adjacent ones of the secondary windings can be kept to a minimum, and that the device can be made compact and lightweight.

What is claimed is:

1. An ignition coil for an internal combustion engine, comprising:

at least three substantially identical transformers each including a core, a primary winding wound around said core, and a secondary winding magnetically coupled to said primary winding via said core;

a case for accommodating said plurality of transformers; and output terminals respectively connected to opposite ends of each of said secondary windings and led out in an identical direction, wherein said plurality of transformers are incorporated in said case in alternatingly different directions, said cores being lengthwise parallel to each other with immediately adjacent transformers being both vertically and horizontally offset, such that odd numbered ones of said transformers are associated with output terminals arranged proximate a first side of said case, and even numbered ones of said transformers are associated with output terminals proximate a second side of said case, said second side of case being opposite said first side of said case.

2. An ignition coil as claimed in claim 1, wherein each of said transformers is insulated and secured by a resin which is filled in said case.

3. The ignition coil of claim 1, wherein said transformers are disposed in said case so that said cores are interdigitated with each other.

* * * * *